US010957181B1

(12) United States Patent
Holub et al.

(10) Patent No.: US 10,957,181 B1
(45) Date of Patent: Mar. 23, 2021

(54) REMOTE GENERATOR SET MONITORING AND CONTROL

(71) Applicant: ComAp a.s., Prague (CZ)

(72) Inventors: Jan Holub, Liberec (CZ); Přemysl Bělaška, Liberec (CZ); Aleksandar Popović, Hameln (DE); Jiri Dunovský, Prague (CZ); Petr Krupanský, Veverská Bítýška (CZ)

(73) Assignee: ComAp a.s., Prague (CZ)

( * ) Notice: Subject to any disclaimer, the term of this patent is extended or adjusted under 35 U.S.C. 154(b) by 0 days.

(21) Appl. No.: 16/677,024

(22) Filed: Nov. 7, 2019

(51) Int. Cl.

| | |
|---|---|
| ***G08B 23/00*** | (2006.01) |
| ***G08B 21/18*** | (2006.01) |
| ***G08B 3/10*** | (2006.01) |
| ***G08C 17/02*** | (2006.01) |

(52) U.S. Cl.
CPC ..... *G08B 21/187* (2013.01); *G08B 3/10* (2013.01); *G08B 21/182* (2013.01); *G08C 17/02* (2013.01); *G08C 2201/30* (2013.01); *G08C 2201/42* (2013.01)

(58) Field of Classification Search
CPC ..... G08B 21/187; G08B 3/10
USPC ..... 340/573.4, 635, 638, 656, 657, 539.23; 703/62
See application file for complete search history.

(56) References Cited

U.S. PATENT DOCUMENTS

| | | | | |
|---|---|---|---|---|
| 5,949,153 | A * | 9/1999 | Tison | H02J 3/24 307/29 |
| 6,653,821 | B2 * | 11/2003 | Kern | H02P 9/04 322/7 |
| 10,203,373 | B1 * | 2/2019 | Horst | H04L 67/30 |
| 2005/0107892 | A1 * | 5/2005 | Matsui | H02J 3/14 700/28 |
| 2013/0175882 | A1 * | 7/2013 | Hayashi | H01M 2/1066 307/149 |
| 2015/0311903 | A1 * | 10/2015 | Frampton | H03L 5/02 700/287 |
| 2019/0018379 | A1 * | 1/2019 | Miller | H04W 4/38 |

* cited by examiner

*Primary Examiner* — Tai T Nguyen
(74) *Attorney, Agent, or Firm* — K&L Gates LLP

(57) ABSTRACT

A generator set monitoring and control system includes a generator set located in a first location, an on-site controller located near the first location, and a remote display, located in a second location. The remote display is configured to send instructions to at least one of the generator set and on-site controller, receive genset operation outputs from the on-site controller, and display genset operation outputs.

18 Claims, 12 Drawing Sheets

REMOTE GENERATOR SET MONITORING AND CONTROL

BACKGROUND

Generator sets or "gensets" are widely used to provide electric power especially in areas that are far from or not connected to a power grid. A genset typically includes an engine coupled to an alternator, which converts the rotational energy from the engine into electrical energy. Typically, an on-site genset controller controls and monitors the operation of a genset, including the operation of the engine and alternator of the genset. The on-site genset controller may be used to control and monitor multiple gensets, including gensets designed and manufactured by different companies. The genset controller may provide control signals to the genset such that the genset operates at optimal performance.

SUMMARY

The present disclosure provides improved remote genset monitoring and control systems, devices and methods to improve the accessibility of genset monitoring and control from remote locations. The control from the remote locations may be conducted in the same or similar way an operator or technician uses an on-site controller. Seamless operation of devices remotely through the on-site controller reduces the need for additional on-site training and expands the possibility to provide additional descriptions and information on an off-site controller, store additional historical data, and add additional features on the off-site controller's user interface compared to a standard on-site controller.

In an example, a generator set monitoring and control system includes a generator set located in a first location, an on-site controller located near the first location, and a remote display, located in a second location. The remote display is configured to send instructions to at least one of the generator set and on-site controller, receive genset operation outputs from the on-site controller, and display genset operation outputs.

In another example, a remote genset controller includes a display device configured to display a user interface where the user interface is based on a second user interface of an on-site controller. The remote genset controller also includes a processor in communication with the display and a communication module in communication with the processor. The communication module is configured to establish communication with the on-site controller. Additionally, the remote genset controller is configured to send instructions to at least one of a generator set and the on-site controller, receive genset operating outputs from the remote genset controller, and display genset operating outputs on the display device.

Additional features and advantages of the disclosed remote genset monitoring and control systems, devices and methods are described in, and will be apparent from, the following Detailed Description and the Figures. The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION OF EXAMPLE EMBODIMENTS

As discussed above, a remote genset monitoring and control systems, devices and methods are provided to improve the accessibility and control of gensets. The remote genset monitoring and control system, device and methods may be used to monitor current operating outputs and control operating parameters of a genset. The above system, device and methods may be used to monitor and control gensets (either on-site or remotely). Remote monitoring and control provides the advantage of accessing controllers installed in the vicinity of gensets (e.g., on-site controllers) that are often located on sites far from operators or technicians. By providing remote monitoring capabilities of current genset operating outputs and providing remote control capabilities of genset operational parameters (e.g., remote access and control via an application on a user device such as a smart phone), the systems, devices and methods disclosed herein advantageously allow for early detection of alarm conditions and other critical operation outputs and control capabilities to remedy the alarm conditions while a technician is off-site. For example, the remote monitoring and control capabilities of the remote display enables the technician to take corrective action by changing or modifying operation parameters (e.g., sending control instructions) before arriving on-site and before genset failure occurs in the same way the technician would operate the on-site controller. The improved accessibility and ease of monitoring and controlling a genset on a mobile device (e.g., remote display) connected to different wireless communication datalinks reduces down-time and reduces maintenance, travel and on-site staffing costs associating with running a genset facility.

Figure 1:
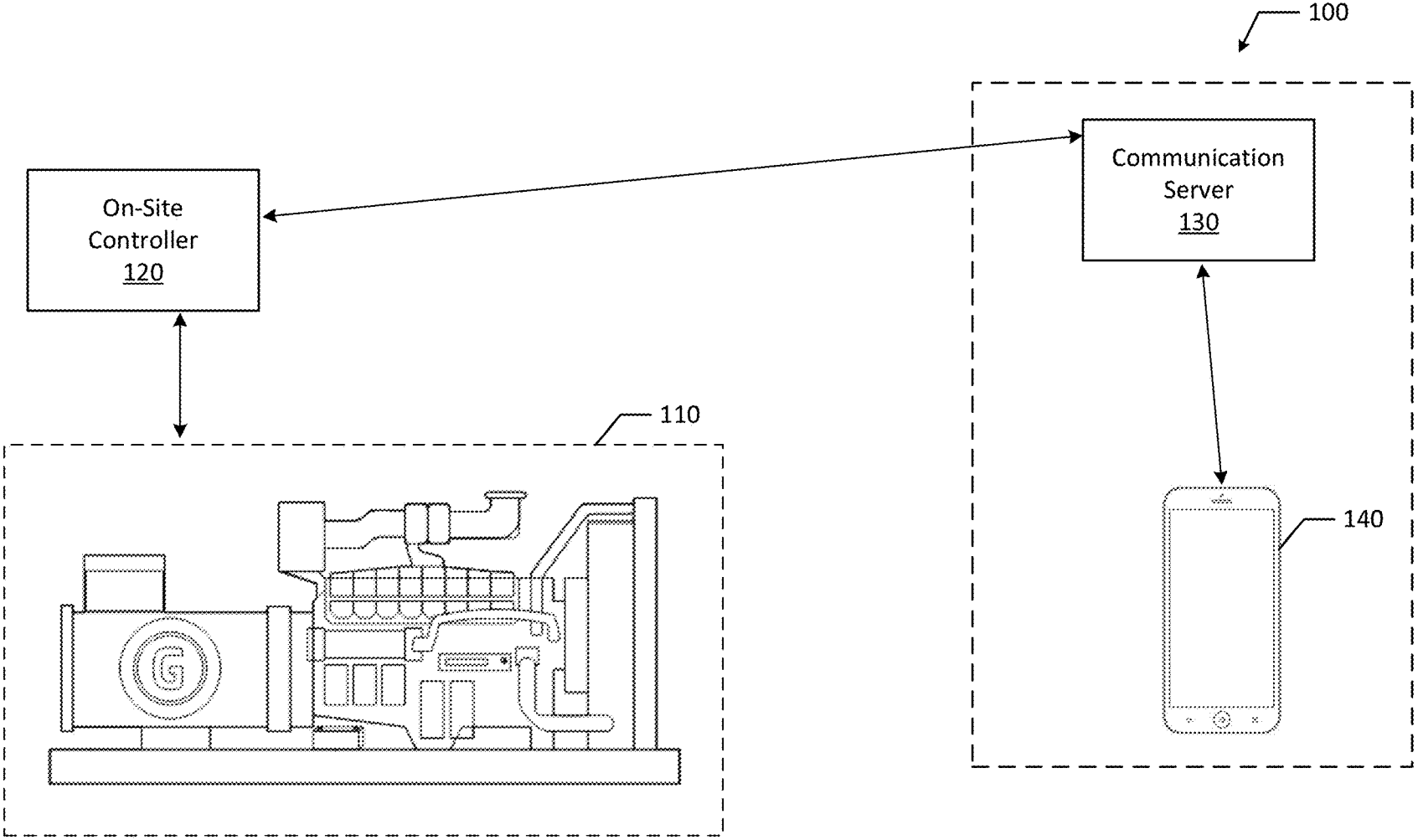
FIG. 1 is a schematic view of a remote genset monitoring and control system according to an example embodiment of the present disclosure

FIG. 1 illustrates a schematic view of a remote monitoring and control system 100. The remote monitoring and control system 100 may include a generator set 110 (e.g., genset 110), an on-site controller 120, a communication server 130 and a remote display 140. The remote display 140 may send instructions to the on-site controller 120 and therefore may serve as a remote controller. The communication server 130 may be a stand-alone device or may be provided as a cloud service. In an example, the communication server 130 may be part of the on-site controller 120, may be part of the mobile device running the remote display 140, or may be part of a mobile application that generates the remote display 140. For example, the communication server 130 may be off-site and in some cases may be integrated on a mobile device such as the remote display 140. In another example, the communication server 130 may be located on-site or near on-site controller 120. Additionally, in some examples, the on-site controller 120 may communicate directly with the remote display 140 without using communication server 130.

The on-site controller 120 may be installed at a genset facility in a control room or near the genset 110. The genset 100 may include various sensors in communication with the on-site controller and/or communication server 130. For example, the genset 110 may include a battery monitor, an alternator winding temperature sensor, a lube oil quality monitor, a structural vibration sensor, a bearing failure sensor, an exhaust temperature sensor, and a lube oil pressure sensor, etc. Additionally, the on-site controller 120 may be connected to other devices and other controllers, breakers, communication bridges, etc. that can provide additional monitoring and sensor capabilities. The various sensing device(s) and monitors enable a technician to monitor and analyze the operating outputs and adjust the operating parameters of the genset 110. For example, data from the various sensing device(s) and monitors may be sent to the on-site controller 120 and then sent to the communication server 130, where it may be stored in an associated database. The on-site controller 120 may periodically send sensor data to the communication server 130 or may send sensor data to the communication server 130 continuously in real-time. In another example, the on-site controller 120 may periodically poll the genset 110 for sensor data. For example, a technician may request current genset operating outputs from the genset 110 through an application on the remote display 140 (e.g., by sending a request through the communication server 130 to the on-site controller 120). In an example, the communication server 130 may be an integral part of the remote display 140.

Since operating outputs may stray from expected ranges and alarm conditions or critical failure may be abrupt, the ability to continually and reliably monitor and control the genset 110 from remote display 140 advantageously reduces failure events and enables technicians to take corrective action (remotely) before a failure event occurs and before arriving on-site. Taking corrective action may advantageously extend the life of the genset 110 and reduce downtime and maintenance costs. For example, as described in more detail below, the remote monitoring and control capabilities of the disclosed system, device and methods advantageously provide remote access so technicians can detect possible future failure scenarios and update the operational parameters of the genset 110 before a failure occurs. The technician may update the operational parameters regardless of their current location (e.g., at remote locations away from the genset facility, at home, at another genset facility, etc.) and at any time of the day.

As discussed below, gensets may be located in remote areas that are difficult to travel to and that may experience extreme weather and environmental conditions including heavy rain (flash flooding, monsoon seasons, etc.), extreme temperatures, which may make travel difficult or dangerous. The remote display 140 advantageously allows technicians to monitor and control gensets 110 off-site, for example, from a protected shelter (away from a genset facility) during extreme weather conditions or while the technicians are home or on-site at another genset facility. Without the ability to remotely monitor and control gensets 110, the genset may continue operating under non-ideal or even potential failure conditions until a technician is able to travel to the genset facility. The inconvenience of having to be on-site to monitor and control a genset 110 may result in less frequent monitoring, which may result in additional maintenance costs and downtime. To improve the accessibility and ease of monitoring and controlling a genset 110, a technician may remotely monitor and control a genset 110 via remote display 140 at remote locations any time of the day.

Figure 2A:
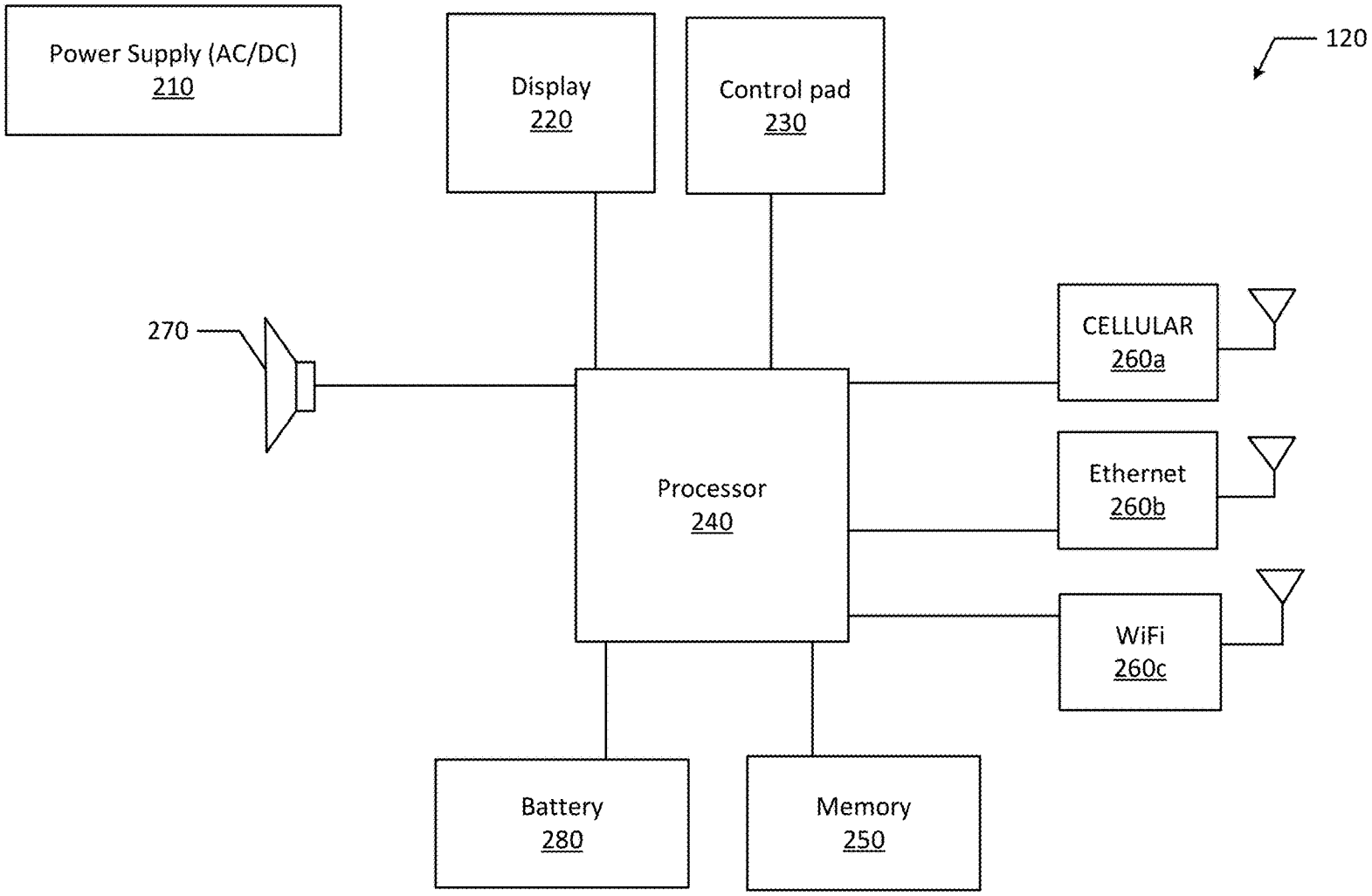
FIG. 2A is a schematic view of internal components of an on-site genset controller according to an example embodiment of the present disclosure.

FIG. 2A illustrates a schematic view of various internal components and modules of on-site controller 120. On-site controller 120 may include a power supply 210, a user interface 215 or display region 220, a control pad 230, a processor 240, a memory 250, and communication modules (e.g., cellular communication module 260*a*, Ethernet communication module 260*b* and a wireless communication module such as a WiFi communication module 260*c*). The on-site controller 120 may be connected to the internet via a mobile network through the cellular communication module 260*a*. Additionally, the on-site controller may be connected to the internet via an Ethernet connection through the Ethernet module 360*b* (e.g., via an Ethernet cable). The on-site controller may establish a connection with the remote display 140 via a WiFi connection through the WiFi module 260*c*.

The on-site controller may also include speakers 270 and a battery 280. The entire user interface 215 may be a display, such as a touchscreen display. In another example, the user interface may include physical buttons or switches with a display region 220. Speakers 270 may emit audible signals to indicate when an alarm condition is present, to provide audible instructions to a technician, or to indicate a selection on user interface 215 and/or control pad 230.

The processor 240 may communicate with the display region 220 and control pad 230. The control pad 230 may be a touchscreen or may include one or more electromechanical input devices, such as a membrane switch(s) or other button(s). In an example, the display region 220 may be a touchscreen display such as a resistive touchscreen. In an example, several of the buttons (e.g., volume control, selection keys, mute, etc.) may instead be displayed as graphical representations on display region 220 and may be selectable by touch.

Figure 2B:
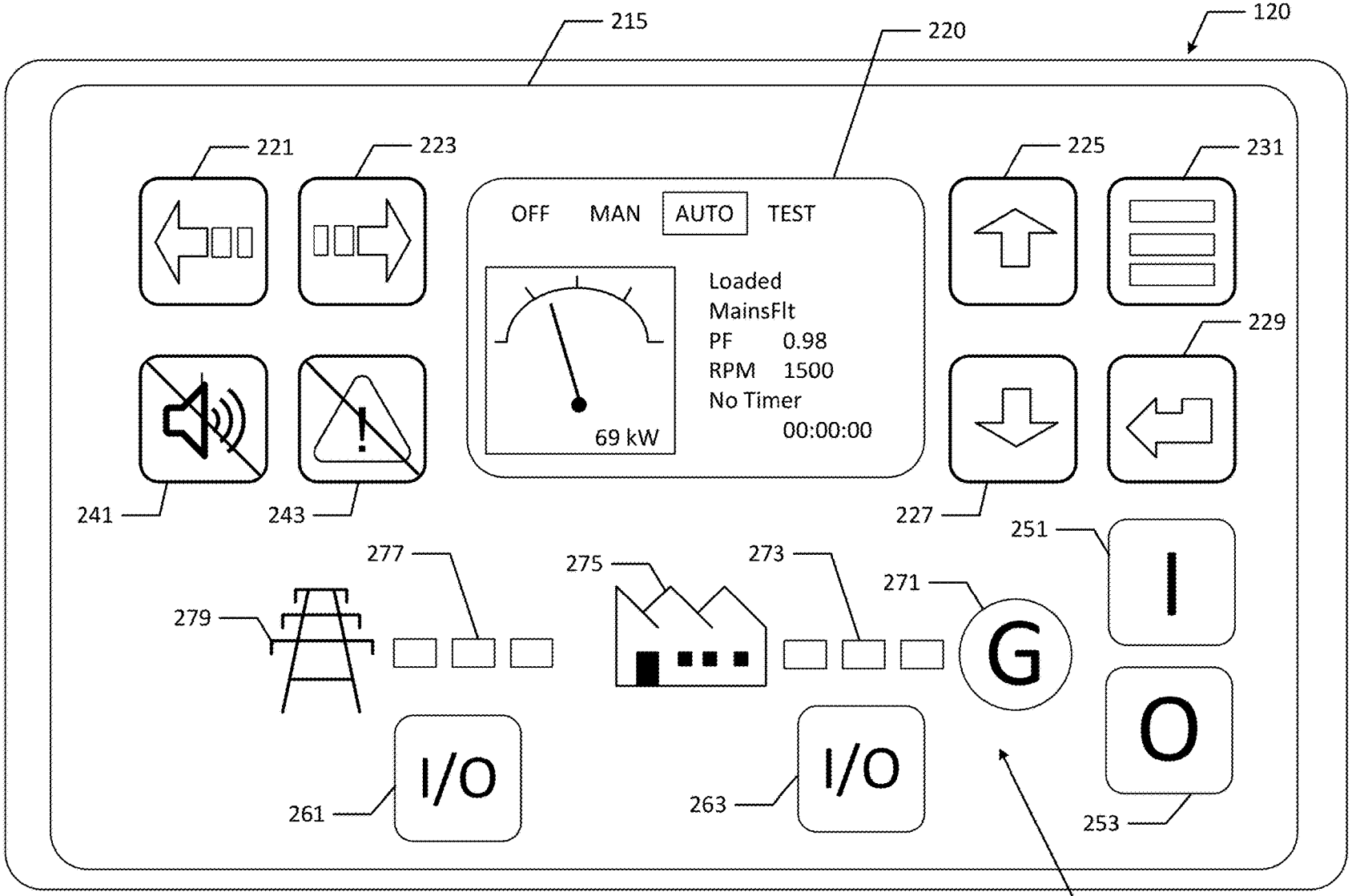
FIG. 2B illustrates an example user interface of an on-site genset controller according to an example embodiment of the present disclosure.

FIG. 2B illustrates an example user interface 215 and layout of an on-site controller 120. As illustrated in FIG. 2B, the on-site controller may include several buttons on control pad 230, such as selection key, sound and mute keys, menu keys, etc. The display region 220 may display current operation parameters of genset 110. In the example illustrated in FIG. 2B, the display region 220 shows that the genset is producing 69 kW, is running at 1500 RPM and has a power factor of 0.98. The display region 220 also shows "OFF", "MAN", "AUTO" and "TEST" modes. The "OFF" mode, the genset 110 may be powered down and may prevent starting the genset 110 until a different mode is selected. In the "MAN" mode, the genset 110 (e.g., engine) may be started and stopped manually using "Start" and "Stop" selection keys (discussed in more detail below). In an example, the genset 110 may be in fully manual control when the "MAN" mode is selected such that the on-site controller 120 does not respond to external signals or conditions. In the "AUTO" mode, the genset 110 may be controlled based on external signals such as a remote start signal or a remote stop signal. Additionally, in the "TEST" mode, the behavior of the on-site controller 120 may depend on the settings selected and other binary inputs.

The "left", "right", "up" and "down" selection keys 221, 223, 225 and 227 allow a technician to move left, right, up and down through selections or to change modes on display region 220. The "up" and "down" selection keys 225 and 227 may also be used to increase and decrease values. A selection key may be a physical button or an icon on a display. An "enter" selection key 229 may be used to finish editing a setpoint while a "page" selection key 231 may be used to switch to different menu options or to different display pages.

Key 241 may disable or reset a horn or other audible signal. Key 243 may reset faults, for example, a technician may use the key 243 to acknowledge alarms and deactivate the horn output. In an example, inactive alarms may disappear immediately and a status of the active alarms may change to "confirmed" after selecting key 243. "Start" and "Stop" selection keys 251 and 253 may initiate start and stop sequences for the genset 110 (e.g., engine). In an example, the "Start" and "Stop" keys 251 and 253 may work in the "MAN" mode.

A generator circuit break ("GCB") selection key 261 may be selected to open or close the GCB or to start synchronization. Additionally, a mains power circuit break ("MCB") selection key 263 may be used to open or close the MCB or to start reverse synchronization.

The on-site controller 120 may also include a generator status indicator 271 that may be illuminated in a first state (e.g., green) when the genset 110 is operating properly and may be illuminated in a second state (e.g., red) due to genset failure. A GCB indicator 273 may indicate that the GCB is on. A load indicator 275 may indicate if a load is being supplied by the genset 110. Additionally, a MCB indicator 277 may indicate that the MCB is on (e.g., the MCB indicator may be green if the MCB is closed and the Mains are healthy). The on-site controller 120 may also include a mains status indicator 279 that may be illuminated in a first state (e.g., green) when the mains are operating properly and may be illuminated in a second state (e.g., red) due to mains failure.

Figure 3A:
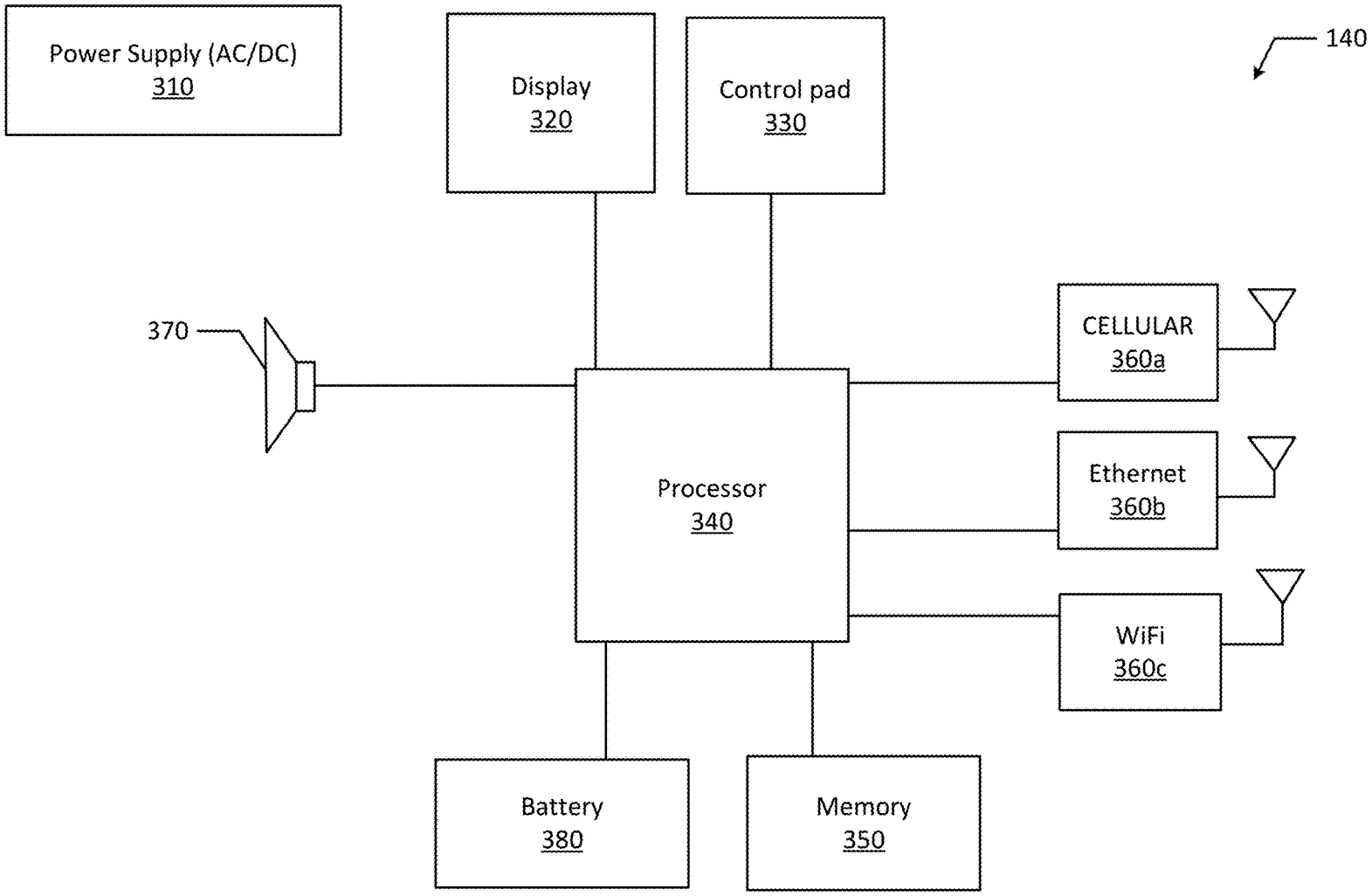
FIG. 3A is a schematic view of internal components of a remote genset display associated with an on-site controller according to an example embodiment of the present disclosure.

FIG. 3A illustrates a schematic view of various internal components and modules of remote display 140. Similar to on-site controller 120, the remote display 140 may include a power supply 310, a user interface 315 or display region 320, a control pad 330, a processor 340, a memory 350, and communication modules (e.g., cellular communication module 360*a*, Ethernet communication module 360*b* and a wireless communications module such as a WiFi communication module 360*c*). The on-site controller may also include speakers 370 and a battery 380. The entire user interface 315 may be a display, such as a touchscreen display. In another example, the user interface may include physical buttons or switches with a display region 320. Speakers 370 may emit audible signals to indicate when an alarm condition is present, to provide audible instructions to a technician, or to indicate a selection on user interface 315 and/or control pad 330.

Figure 3B:
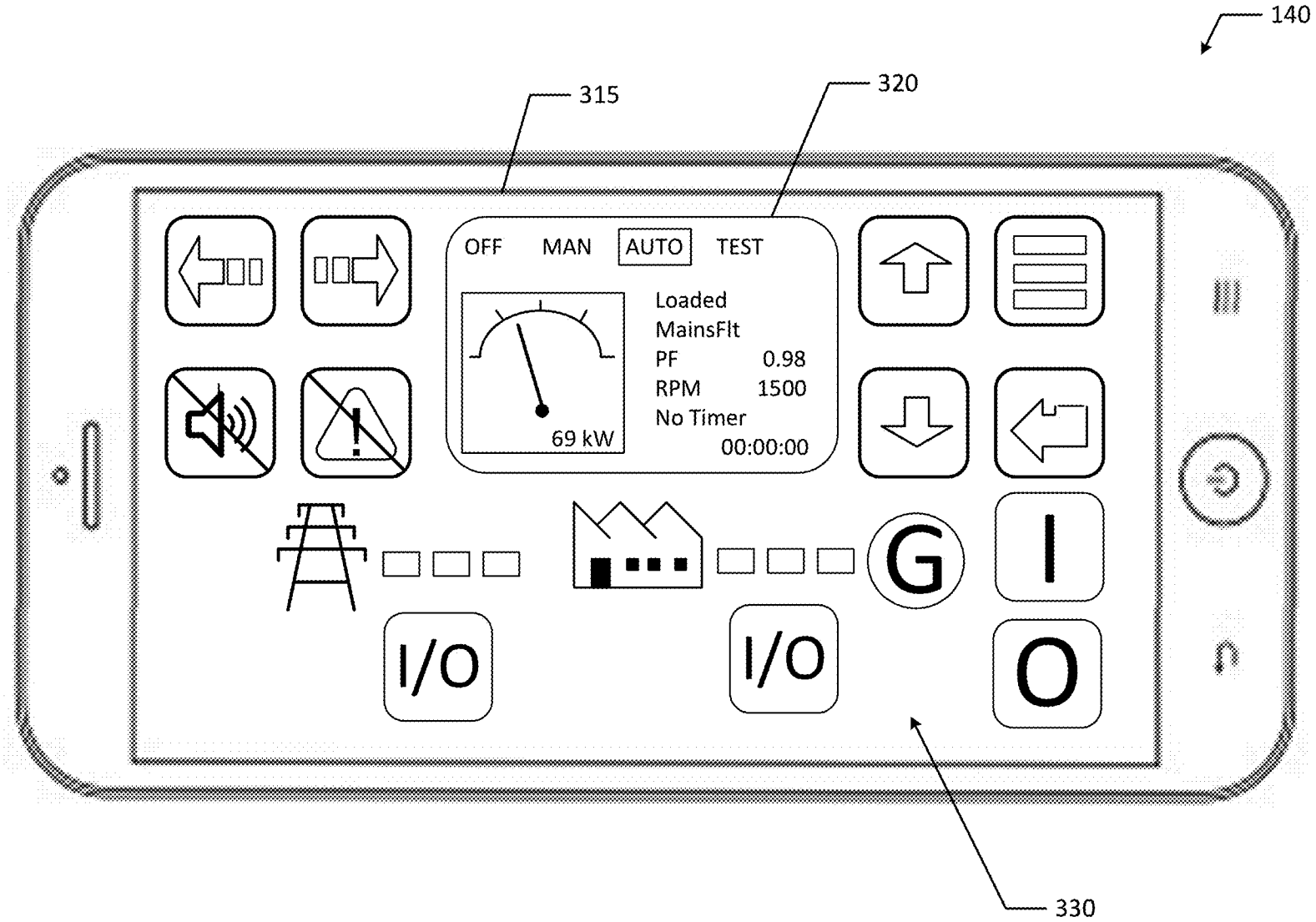
FIG. 3B illustrates an example user interface of a remote genset display according to an example embodiment of the present disclosure.

FIG. 3B illustrates an example user interface 315 and layout of a monitoring and control application on remote display 140. It should be appreciated that remote display 140 may be a smartphone, tablet, laptop, computer, smartwatch, or any other suitable device. The monitoring and control application on remote display 140 may include the same or similar displays and controls as the on-site controller 120. For example, the remote display 140 may display the same operational parameters as the on-site controller 120 and may include the same control functionality (e.g., the same buttons as control pad 220). As discussed in more detail below, the remote display may have user interface 315 that is a human-machine interface that mimics the user interface 215 of the on-site controller 120.

As illustrated in FIGS. 2B and 3B, the user interfaces 215 and 315 may include display regions 220, 320, which provide a visual indication of various operating parameters. In an example, the visual indication may include gauge (e.g. kW gauge, RPM gauge, etc.) that indicates the current operating parameters of the genset 110. Additionally, the display regions 220, 230 may display a visual numeric value representing the operating parameters (e.g., "RPM 1500"). The visual indicators allow the technicians to review and analyze the genset operating outputs and provide adjustments, when necessary.

As illustrated in FIG. 2A and FIG. 3A, the remote display 140 has a user interface 315 that mimics to that of on-site controller 120 to enable interoperability between the remote display 140 and on-site controller 120. For example, since the remote display 140 has a user interface 315 that mimics the user interface 215 of on-site controller 120, the remote display 140 may be used for various different on-site controllers 120 and provides simplified interoperability between different devices. The user interface 315 may mimic or may be derived from the user interface 215 of the on-site controller. A technician may send the control instructions to the genset 110 (e.g., through the communication server 130 and on-site controller 120) remotely from the remote display 140 as if the technician was on-site using on-site controller 120. For example, remote display 140 may have the same control functionality as on-site controller 120. Similar to the on-site controller 120, a technician may monitor genset operation outputs, control operational parameters of genset 110, edit set points, start or stop the genset 110, configure inputs and outputs, access and review alarm information and other event history information through the remote display 140.

For example, a technician may monitor a genset battery, alternator, lube oil, vibrations, bearings, exhaust temperature, genset RPMs, genset power output, etc. from various genset monitors, sensors and gauges while on-site at a genset facility using the on-site controller. Specifically, a technician may monitor the genset power output in real time while on-site as the power output may be displayed on the user interface 215 or display region 220 of the on-site controller 120. Similarly, a technician may monitor the genset power output in real time or near real time while off-site using the remote display 140. For example, the remote display 140 may display the same power output value as the on-site controller 120.

A technician may send instructions to the genset 110 via on-site controller 120 and may similarly send control instructions to the genset 110 via the remote display 140. For example, while off-site, the technician may send a power down instruction to genset 110 via remote display 140.

The user interface 315 of the remote display may be a human-machine interface ("HMI") that is connected to and mimics the layout of user interface 215 of on-site controller 120. For example, a control room may have multiple on-site controllers 120 for different generators or gensets 110 at a genset facility. Each of the on-site controllers 120 may have a different layout and configuration of the user interface 215.

In an example, the various configurations and layouts of on-site controllers 120 may be predefined within the control application or built-in to the control application of remote display 140. In another example, the user interface 315 of the remote display 140 may be an HMI that connects to the specific on-site controller 120 and allows the technician to interact with the specific on-site controller 120. For example, the remote display 140 may read the HMI layout or configuration from the on-site controller 120 and may mimic the user interface 215 of the on-site controller 120. After reading the HMI configuration or layout from the on-site controller 120, the control application of remote display 140 may generate a user interface or display screen that matches the user interface 215 of the on-site controller 120. By reading the HMI configuration and layout from the on-site controller 120, the control application of remote display 140 may have increased compatibility with different on-site controllers 120 without having to update the predefined or built-in configurations of the control application of remote display 140.

The communication modules 260 and 360 (e.g., cellular communication module, Ethernet communication module and WiFi communication module) may communicate with processors 240 and 340 and may send data to and receive data from communication server 130. The communication modules 260 and 360 allow technicians to use remote display 140 to provide remote monitoring and control to genset 110. For example, remote display 140 may send control instructions to on-site controller 120. The communication modules 260 and 360 along with communication server 130 allow a technician to monitor and control genset 110 anytime both on-site and at remote locations (e.g., outside of control room, from home, etc.). Additionally, the various communication modules allow a technician to monitor and control genset 110 with or without internet connectivity. For example, the remote display 140 may communicate with on-site controller 120 with an internet connection, through wireless (e.g., WiFi, Bluetooth, etc.) or through cellular based connections.

The controllers 120, 140 (e.g., on-site controller 120 and remote display 140) may be used to monitor operating outputs and values of genset 110. For example, the controllers 120, 140 (e.g., on-site controller 120 and remote display 140) may review parameters such as RPM, power output, fuel consumption, exhaust temperature, etc. Additionally, the controllers may view and review operating parameter history logs as well as alarm and warning logs.

The on-site controller 120 and/or remote display 140 may be used to send control instructions and apply genset operating configurations to the genset 110. Each of the controllers 120, 140 (e.g., on-site controller 120 and remote display 140) may communicate with the communication server 130, which may also include a database and other backend components. In an example, communication between controllers 120, 140 and the communication server 130 may be encrypted. For example, communication encryption may include over-the-air ("OTA") encryption with WiFi Protected Access ("WPA") or WiFi Protected Access II ("WPA2"). Additionally, communication between controllers 120, 140 and the communication server 130 may utilize a communication protocol, such as Secured Sockets Layer ("SSL"), Transmission Control Protocol ("TCP"), Internet Protocol ("IP") and Transport Layer Security ("TLS") protocol to provide secure communication on the Internet for data transfers.

Figure 4:
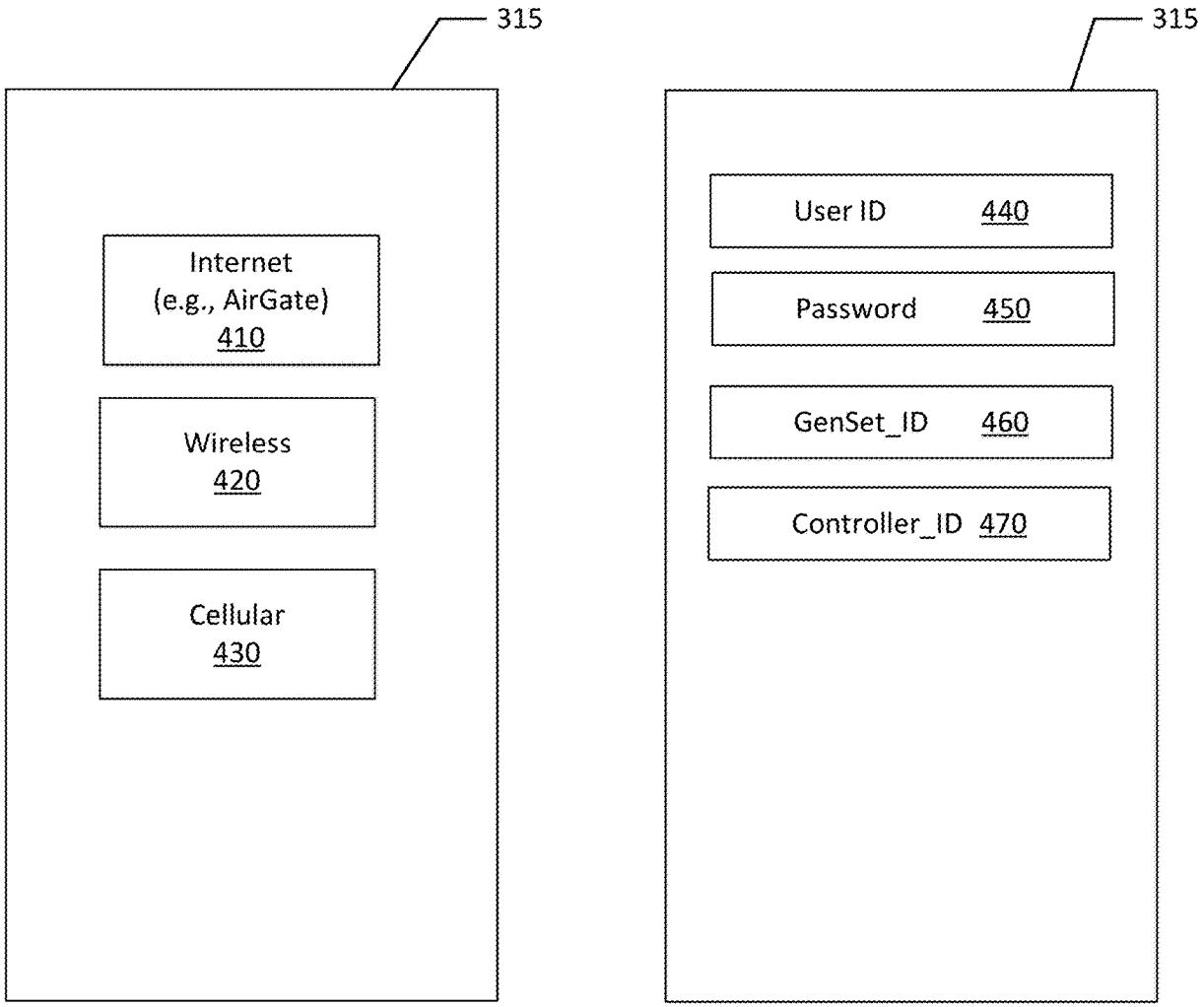
FIG. 4 illustrates an example display screen of a remote genset display according to an example embodiment of the present disclosure.

Technicians may be provided access rights or privileges for specific on-site controllers 120 or gensets 110. For example, before monitoring a genset 110 or sending control instructions to an on-site controller 120, the technician may sign-in and connect to a specific on-site controller(s). As illustrated in FIG. 4, the technician may select their connection mode by selecting a connection icon that indicates an internet connection (e.g., icon 410), Wireless connection (e.g., icon 420) or cellular connection (e.g., icon 430). Then, the technician may sign-in by entering a user ID 440 and a password 450. The technician may also be prompted to enter a genset_ID 460 and/or a controller_ID 470. After entering login credentials, the technician may be confirmed as a privileged user with access rights to one or more gensets 110 or on-site controllers 120. However, various other authentication processes may be used. Technicians may communicate with and manage data within communication server 130. In an example, a genset_ID or model number may be associated with a specific genset 110 or on-site controller 120 such that only certain technicians may monitor and control the genset 110. Specifically, a technician may be granted access to a specific genset 110 or genset controller 120.

For example, data specific to various on-site controller(s) 120 and gensets 110 may be stored on a database associated with communication server 130. "Technician_A" may be assigned access rights or privileges to monitor and control gensets 110 at one genset facility (e.g., located in Brazil) while "Technician_B" may be assigned access rights or privileges to monitor and control gensets 110 at another genset facility (e.g., located in North America). As discussed above, the communication server 130 may be a stand-alone device or may be provided as a cloud service. For example, the communication server 130 may be off-site and in some cases may be integrated on a mobile device such as the remote display 140.

Then, after confirmation, the remote display 140 may connect to the one or more on-site controllers 120. As discussed above, the remote display 140 may obtain HMI configuration or layout information from the on-site controller(s) 120 before generating a display of the user interface 315. Once connected with a generated user interface 315, the technician may monitor and/or control genset(s) 110. In another example the control application or program for the remote display 140 may translate language included on the user interface 215 from one language to a different language and may generate the user interface 315 with the translated text. By translating text, the remote display 140 may be used by various technicians with different language backgrounds whereas an on-site controller may only include a user interface 215 in a single language.

Figure 5A:
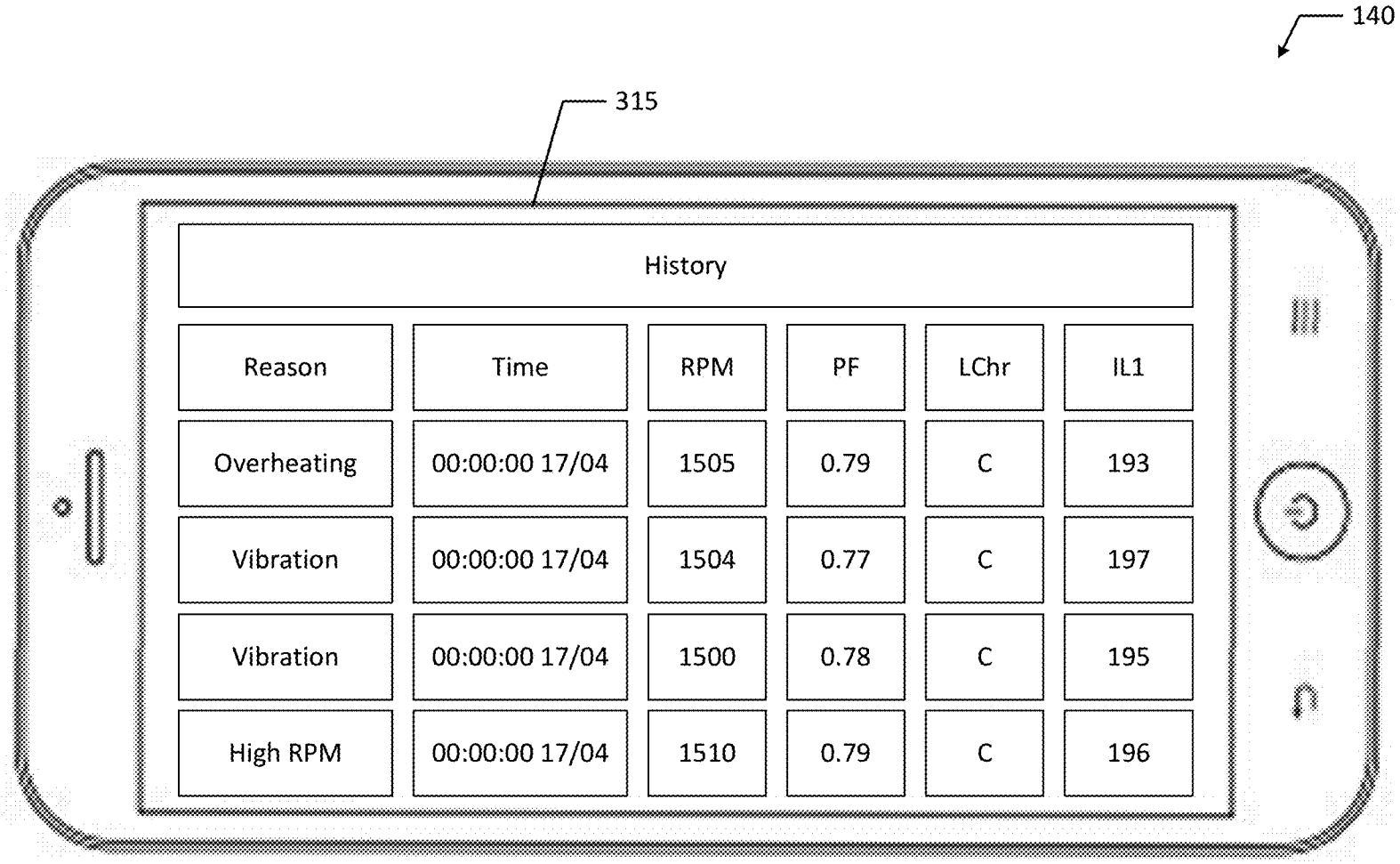
FIGS. 5A, 5B, 5C, 5D and 5E illustrate example display screens of a remote genset display according to example embodiments of the present disclosure.

FIG. 5A illustrates an example user interface 315 displaying alarm history information and/or general events history. The alarm history information indicates various alarms that were triggered due to overheating, vibration and high RPMs. Each of the alarms may have an associated timestamp as well as genset operation outputs (e.g., RPM, power factor ("PF"), generator load character ("LChr"), and generator current phase such as IL1). In an example, remote display 140 may provide additional display functionality than on-site controller 120. For example, the alarm history and/or general events history display screen may allow a user to select an alarm event or general history event, which may be displayed on a larger screen of the remote display 140 for enhanced visualization. In an example, the remote display 140 may display additional information above and beyond what is displayed by on-site controller 120. In another example, the remote display 140 may provide additional functionality to analyze sensor data and operation output signals. The remote display 140 and underlying application may analyze trends of alarm and event histories.

Figure 5B:
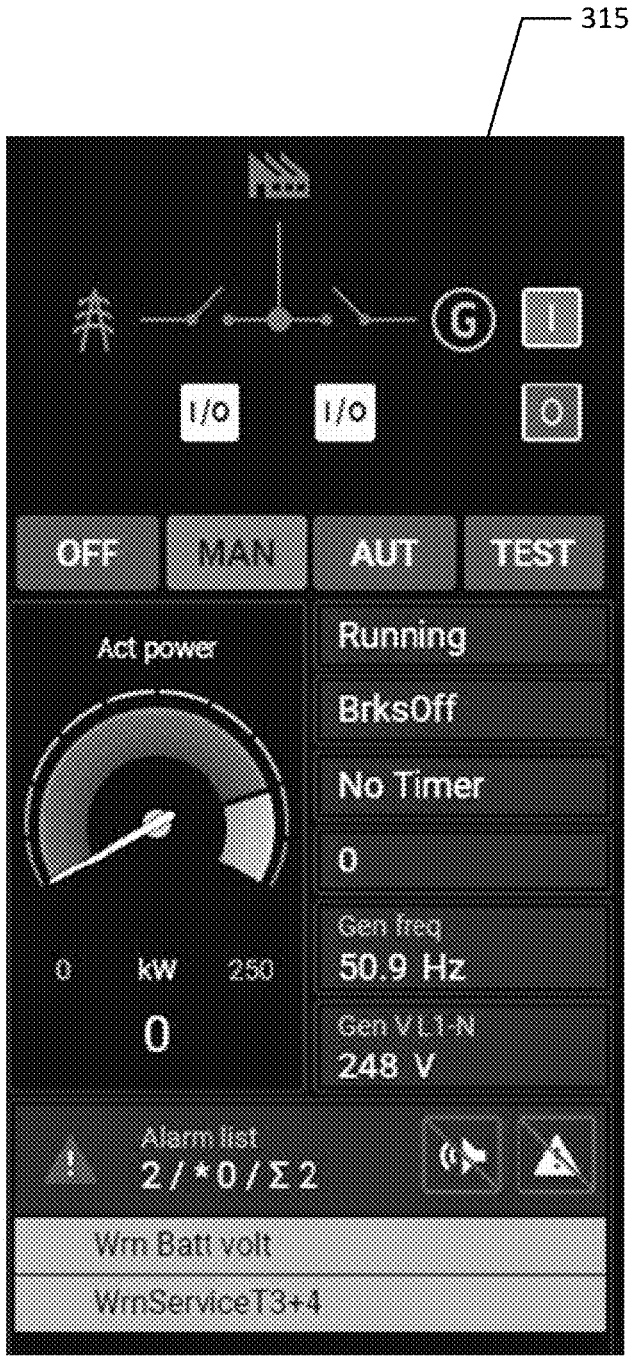
Figure 5C:
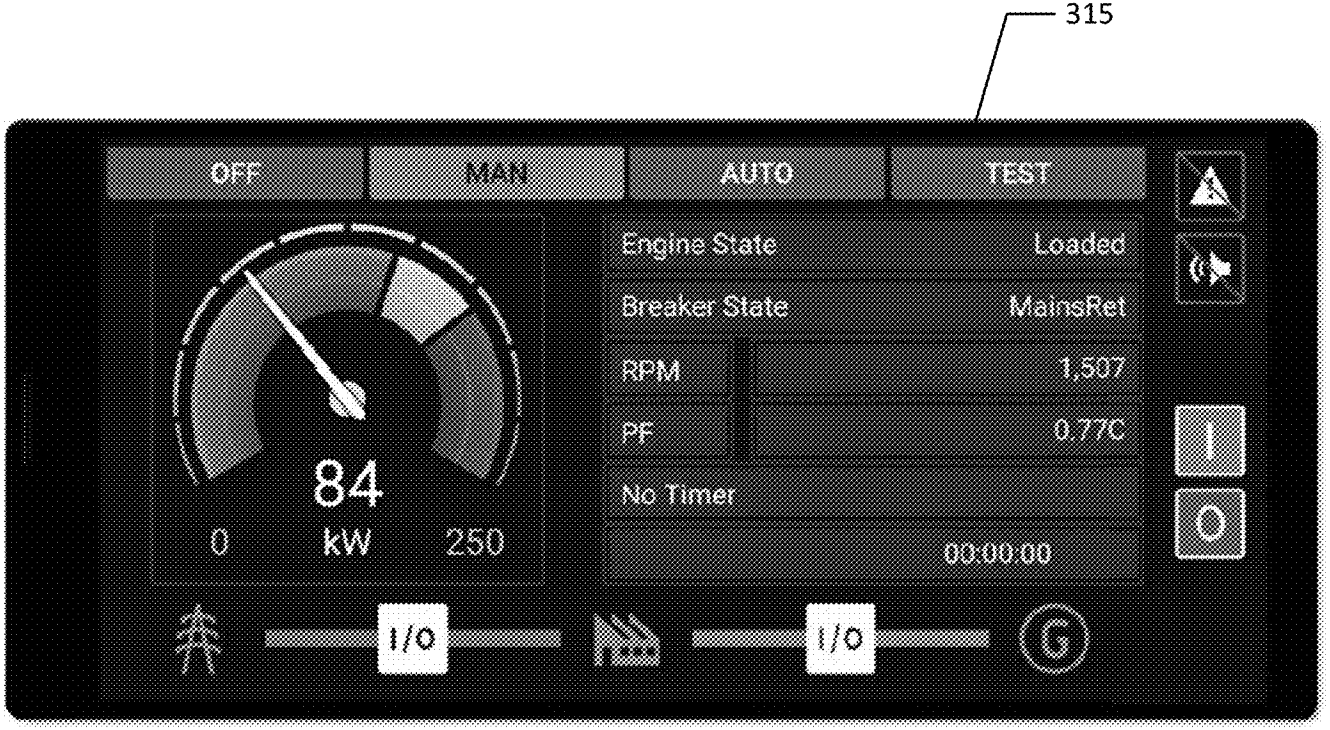

FIG. 5B illustrates an example user interface 315 displaying the current power output of a genset 110. FIG. 5C illustrates another example user interface 315 displaying operation outputs of a genset 110. In the illustrated example, the operation outputs include 84 kW power output, the current engine state, the current breaker state, the operation RPMs and PF. From the display screens illustrated in FIG. 5B and FIG. 5C, a technician may monitor operation outputs and may choose to send updated control instructions to a genset 110 remotely from the remote display 140 to the on-site controller 120 to alter the operational parameters to change the future operation outputs of genset 110. For example, a technician may choose to reduce to RPM and power output of a genset 110 during non-peak hours or may remotely turn-off a genset so that routine maintenance may be performed.

Figure 5D:
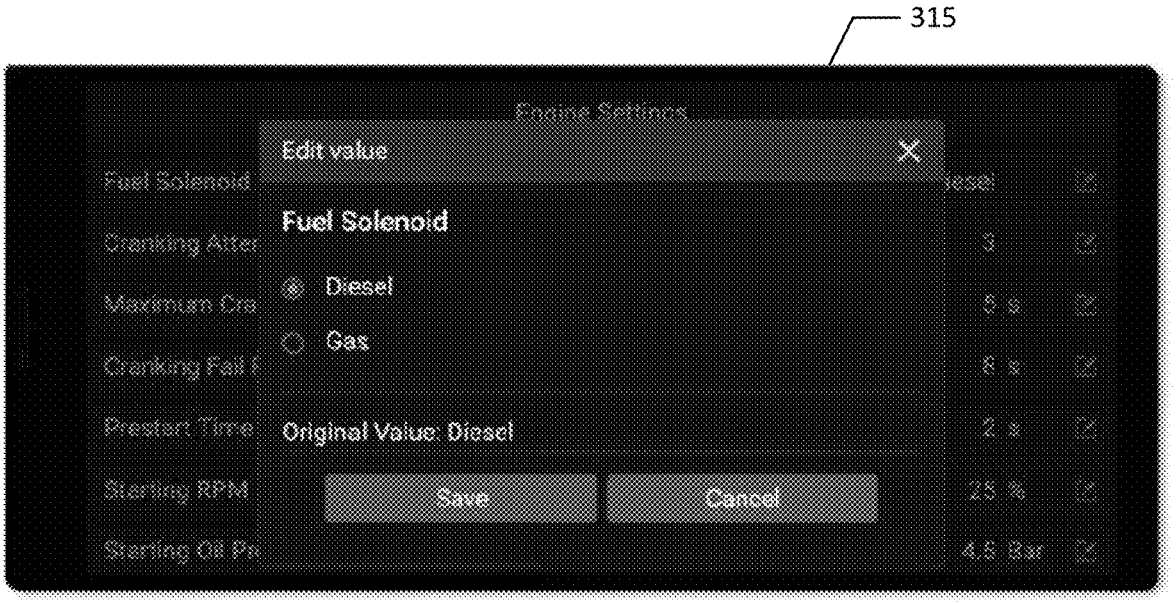
Figure 5E:
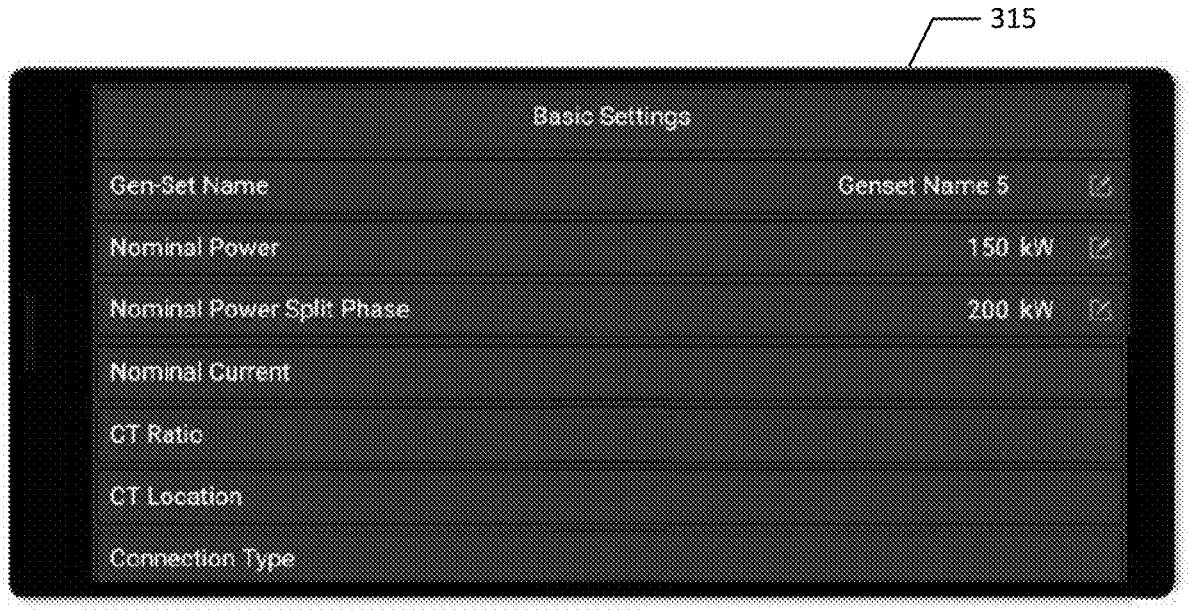

FIG. 5D illustrates an example user interface 315 displaying options to edit operating parameters or set points such as the type of fuel (e.g., diesel or gas), the prestart time, starting RMP, starting oil pressure, etc. FIG. 5E illustrates another example user interface 315 displaying genset information such as the "Gen-Set Name" or "genset_ID", the nominal power, nominal current, etc. From the display screens illustrated in FIG. 5D and FIG. 5E, a technician may modify operational parameters to send updated control instructions to a genset 110 remotely from the remote display 140 to the on-site controller 120.

Figure 6A:
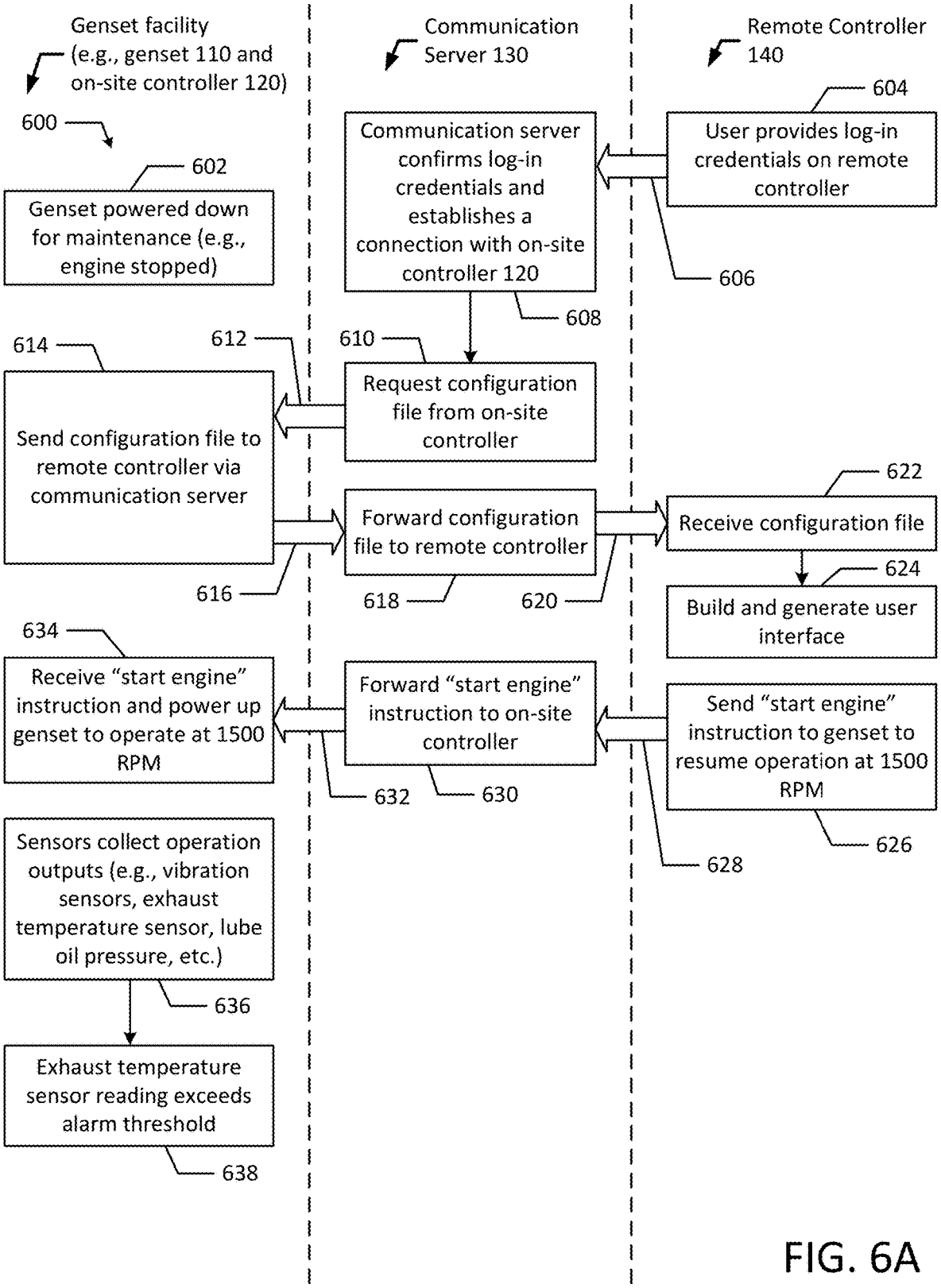
FIGS. 6A and 6B illustrate a flow diagram of an example process for remote genset monitoring and control according to an example embodiment of the present disclosure.
Figure 6B:
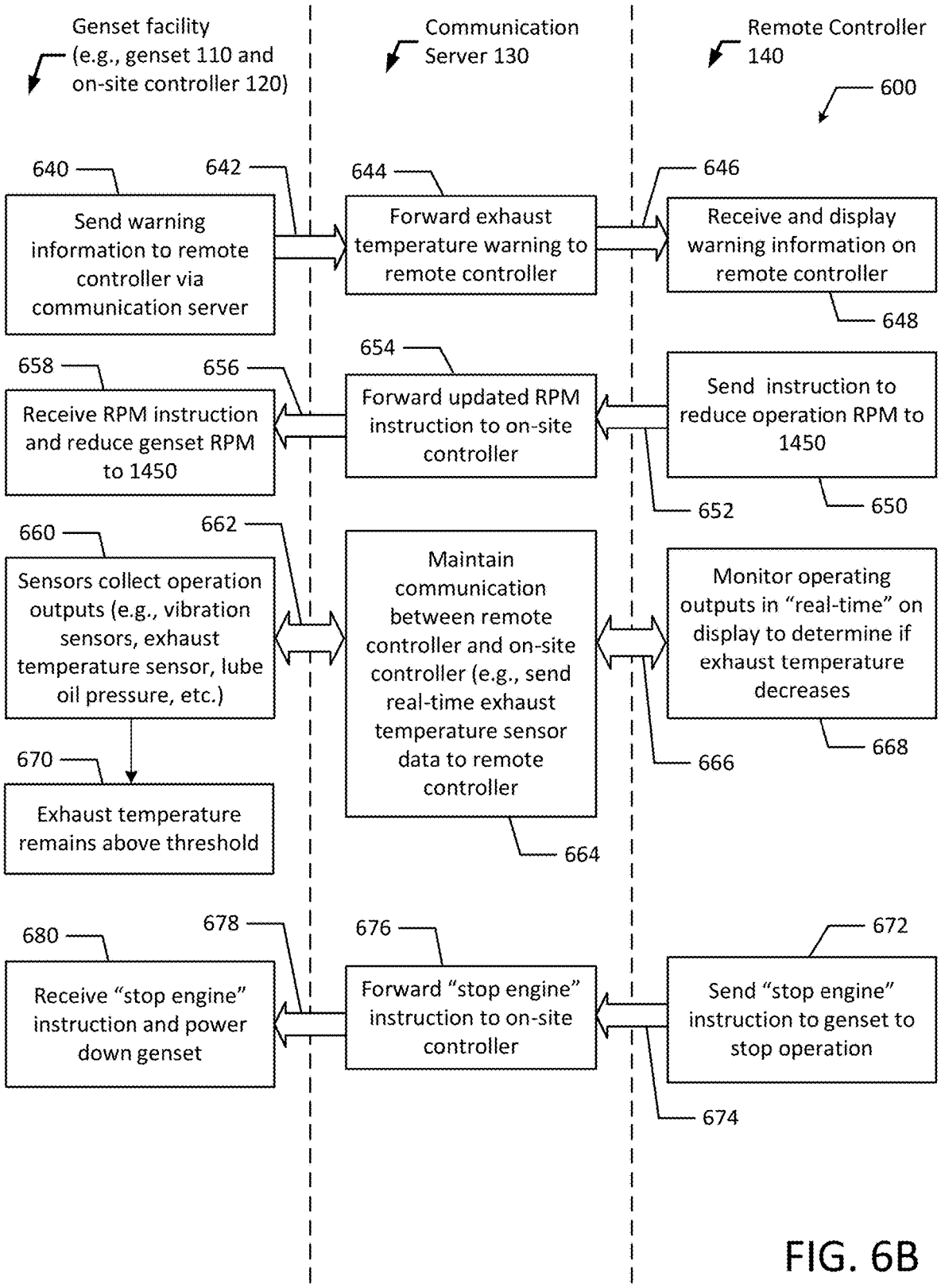

FIGS. 6A and 6B illustrate a flowchart of an example method 600 of remotely monitoring and controlling a genset in accordance with an example of the present disclosure. Although the example method 600 is described with reference to the flowchart illustrated in FIGS. 6A and 6B it will be appreciated that many other methods of performing the acts associated with the method 600 may be used. For example, the order of some of the blocks may be changed, certain blocks may be combined with other blocks, and some of the blocks described are optional. For example, a genset 110, on-site controller 120, and remote display 140 may communicate via a communication server 130 to perform example method 600.

In the illustrated example, the genset 110 is powered down for maintenance (block 602). For example, the genset 110 may have received repairs or a routine maintenance check earlier in the day. A user (e.g., technician) may decide to power up the genset 110 from a remote location and may provide log-in credentials (e.g., username, password, Genset_ID, on-site controller_ID, etc.) on the remote display 140 (blocks 604 and 606), which are then conveyed to the communication server 130. The communication server receives the log-in credentials, confirms the credentials and establishes connection with the on-site controller 120 (block 608). In another example, the credentials may be verified in on-site controller 120.

Then, the communication server 130 requests the configuration file from the on-site controller 120 (blocks 610 and 612). The request may be initiated from the remote display 140 or may automatically be initiated by the communication server 130 after establishing connection with the on-site controller 120. The on-site controller 120 receives the request and sends the configuration file to the remote display 140 via the communication server 130 (blocks 614 and 616). Then, the communication server 130 forwards the configuration file to the remote display 140 (blocks 618 and 620). In an example, the configuration file may include HMI layout information of the on-site controller 120.

Then, the remote display 140 receives the configuration file (block 622) and builds/generates the user interface of the remote display 140 (block 624). In an example, the configuration file includes the HMI layout information of the on-site controller so the user interface of the remote display 140 mimics the user interface of the on-site controller 120. For example, after reading the HMI configuration or layout from the on-site controller 120, the control application of remote display 140 may generate a user interface or display screen that matches the user interface 215 of the on-site controller 120. By reading the HMI configuration and layout from the on-site controller 120, the remote display 140 may be compatibility with different on-site controllers 120 without having to update the predefined or built-in configurations of the control application of remote display 140.

After establishing connection and building the user interface, the user (e.g., technician) may send a "resume operation" instruction to the genset 110 (e.g., sending instruction to on-site controller 120 associated with genset 110) to resume operation at 1500 RPM (blocks 626 and 628). By sending the instruction from remote display 140, the technician may advantageously power up the genset 110 from remote locations without having to travel to the genset facility. Then, the communication module 130 receives the instruction and forwards the "resume operation" instruction to the on-site controller 120 (blocks 630 and 632). The on-site controller receives the "resume operation instruction" and sends a control signal to the genset 110 such that the genset 110 powers up and begins operating at 1500 RPM (block 634).

After resuming operation, various sensors on the genset 110 collect operation outputs (e.g., vibration data from vibration sensors, exhaust temperature data from exhaust temperature sensors, lube oil pressure data from oil pressure sensors, etc.) (block 634). After some time, the exhaust temperature sensor reading exceeds a predetermined alarm threshold (block 638). Continuing on FIG. 6B, the reading triggers the on-site controller 120 to send alarm or warning information to the remote display 140 via the communication server 130 (blocks 640 and 642). The communication server 130 receives the alarm or warning information and forwards the exhaust temperature warning to the remote display 140 (blocks 644 and 646).

The remote display 140 receives and displays the exhaust temperature warning information (block 648). Additionally, the remote display 140 may sound audible alarm along with the displayed warning information. Based on the warning information, the technician may decide to lower the genset RPMs in an attempt to bring the exhaust temperature back to safe operating parameters. For example, the user (e.g., technician) may send and instruction reduce operation RPMs to 1450 (blocks 650 and 652). The communication server 130 receives the updated instruction and forwards the updated instruction to the on-site controller 120 (blocks 654 and 656). The on-site controller receives the updated instruction and sends a control signal to the genset 110 such that the genset 110 reduces operating RPMs from 1500 RPM to 1450 RPM (block 658).

After reducing RPM, the various sensors on the genset 110 continue to collect operation outputs (e.g., vibration data from vibration sensors, exhaust temperature data from exhaust temperature sensors, lube oil pressure data from oil pressure sensors, etc.) (block 660), which are communicated from the genset 110 and on-site controller 120 to the remote display 140 in real-time or near real-time (blocks 662, 664 and 666) such that the user (e.g., technician) can monitor the operating outputs on the display (block 668). For example, the technician can monitor the operating outputs in real-time or near real-time to determine if the exhaust temperature starts to decrease below the alarm threshold.

However, in the illustrated example, the exhaust temperature remains above the alarm threshold (block 670) and to avoid damage to the genset 110, the user (e.g., technician) sends a "power down" instruction from the remote display 140 to the genset 110 to stop operation blocks 672 and 674. The communication server 130 receives the "power down" instruction and forwards the "power down" instruction to the on-site controller 120 (blocks 676 and 678). Then, the on-site controller receives the forwarded "power down" instruction and powers down the genset 110 to prevent further damage caused by increased exhaust temperatures (block 680). In the illustrated example, the technician remotely monitored and controlled genset 110 through remote display 140, which allowed the technician to power down the genset 110 after an alarm was triggered and unresolved thereby avoiding further damage to the genset 110.

As used herein, physical processor or processor 240, 340 refers to a device capable of executing instructions encoding arithmetic, logical, and/or I/O operations. In one illustrative example, a processor may follow Von Neumann architectural model and may include an arithmetic logic unit ("ALU"), a control unit, and a plurality of registers. In a further aspect, a processor may be a single core processor which is typically capable of executing one instruction at a time (or process a single pipeline of instructions), or a multi-core processor which may simultaneously execute multiple instructions. In another aspect, a processor may be implemented as a single integrated circuit, two or more integrated circuits, or may be a component of a multi-chip module (e.g., in which individual microprocessor dies are included in a single integrated circuit package and hence share a single socket). A processor may also be referred to as a central processing unit ("CPU"). Additionally a processor may be a microprocessor, microcontroller or microcontroller unit ("MCU").

As discussed herein, a memory device or memory 250, 350 refers to a volatile or non-volatile memory device, such as random access memory ("RAM"), read-only memory ("ROM"), electrically erasable programmable read-only memory ("EEPROM"), or any other device capable of storing data.

Processors 240, 340 may be interconnected using a variety of techniques, ranging from a point-to-point processor interconnect, to a system area network, such as an Ethernet-based network.

Aspects of the subject matter described herein may be useful alone or in combination with one or more other aspects described herein. In a first exemplary aspect of the present disclosure a generator set monitoring and control system includes a generator set located in a first location, an on-site controller located near the first location, and a remote display, located in a second location. The remote display is configured to send instructions to at least one of the generator set and on-site controller, receive genset operation outputs from the on-site controller, and display genset operation outputs.

In accordance with another exemplary aspect of the present disclosure, which may be used in combination with any one or more of the preceding aspects, the generator set monitoring and control system includes a communication server.

In accordance with another exemplary aspect of the present disclosure, which may be used in combination with any one or more of the preceding aspects, the remote display is configured to send instructions to the on-site controller via the communication server.

In accordance with another exemplary aspect of the present disclosure, which may be used in combination with any one or more of the preceding aspects, the remote display is configured to receive genset operation outputs from the communication server.

In accordance with another exemplary aspect of the present disclosure, which may be used in combination with any one or more of the preceding aspects, the remote display further includes a user interface configured to display the genset operation outputs.

In accordance with another exemplary aspect of the present disclosure, which may be used in combination with any one or more of the preceding aspects, the remote display further includes at least one speaker configured to emit an audible alarm signal.

In accordance with another exemplary aspect of the present disclosure, which may be used in combination with any one or more of the preceding aspects, the on-site controller has a first user interface associated with a configuration, and the remote display has a second user interface that is generated based on the configuration of the first user interface.

In accordance with another exemplary aspect of the present disclosure, which may be used in combination with any one or more of the preceding aspects, the configuration is a human-machine interface configuration file.

In accordance with another exemplary aspect of the present disclosure, which may be used in combination with any one or more of the preceding aspects, the remote display is configured to translate text of the first user interface into a different language.

In accordance with another exemplary aspect of the present disclosure, which may be used in combination with any one or more of the preceding aspects, the remote display is configured to display the second user interface with the translated text of the first user interface.

In accordance with another exemplary aspect of the present disclosure, which may be used in combination with any one or more of the preceding aspects, the genset operation outputs include a battery monitor, an alternator winding temperature sensor, a lube oil quality monitor, a structural vibration sensor, a bearing failure sensor, an exhaust temperature sensor, and/or a lube oil pressure sensor.

In accordance with another exemplary aspect of the present disclosure, which may be used in combination with any one or more of the preceding aspects, the remote display is configured to emit an alarm when at least one of the genset operation outputs exceeds a respective alarm threshold.

In accordance with another exemplary aspect of the present disclosure, which may be used in combination with any one or more of the preceding aspects, the first location and the second location are different locations.

In accordance with another exemplary aspect of the present disclosure, which may be used in combination with any one or more of the preceding aspects, the first location and the second location are at least 50 km apart.

In accordance with another exemplary aspect of the present disclosure, which may be used in combination with any one or more of the preceding aspects, the system includes a communication server, and communication between the on-site controller and the remote display is routed via the communication server.

Aspects of the subject matter described herein may be useful alone or in combination with one or more other aspects described herein. In a second exemplary aspect of the present disclosure, a remote genset controller includes a display device configured to display a user interface where the user interface is based on a second user interface of an on-site controller. The remote genset controller also includes a processor in communication with the display and a communication module in communication with the processor. The communication module is configured to establish communication with the on-site controller. Additionally, the remote genset controller is configured to send instructions to at least one of a generator set and the on-site controller, receive genset operating outputs from the remote genset controller, and display genset operating outputs on the display device.

In accordance with another exemplary aspect of the present disclosure, which may be used in combination with any one or more of the preceding aspects, the communication module is configured to establish communication with the on-site controller.

In accordance with another exemplary aspect of the present disclosure, which may be used in combination with any one or more of the preceding aspects, the remote genset controller is configured to send instructions to the on-site controller via the communication server.

In accordance with another exemplary aspect of the present disclosure, which may be used in combination with any one or more of the preceding aspects, the remote genset controller is configured to receive genset operation outputs from the communication server.

In accordance with another exemplary aspect of the present disclosure, which may be used in combination with any one or more of the preceding aspects, the remote controller further includes a user interface configured to display the genset operating outputs.

In accordance with another exemplary aspect of the present disclosure, which may be used in combination with any one or more of the preceding aspects, the remote controller further includes at least one speaker configured to emit an audible alarm signal.

In accordance with another exemplary aspect of the present disclosure, which may be used in combination with any one or more of the preceding aspects, the remote genset controller includes user interface that is generated based on a configuration of a second interface of the on-site controller.

In accordance with another exemplary aspect of the present disclosure, which may be used in combination with any one or more of the preceding aspects, the configuration is a human-machine interface configuration file.

In accordance with another exemplary aspect of the present disclosure, which may be used in combination with any one or more of the preceding aspects, the remote genset controller is configured to translate text of the first user interface into a different language.

In accordance with another exemplary aspect of the present disclosure, which may be used in combination with any one or more of the preceding aspects, the remote genset controller is configured to display the user interface with the translated text of the second user interface.

In accordance with another exemplary aspect of the present disclosure, which may be used in combination with any one or more of the preceding aspects, the genset operating outputs include a battery monitor, an alternator winding temperature sensor, a lube oil quality monitor, a structural vibration sensor, a bearing failure sensor, an exhaust temperature sensor, and/or a lube oil pressure sensor.

In accordance with another exemplary aspect of the present disclosure, which may be used in combination with any one or more of the preceding aspects, the remote genset controller is configured to emit an alarm when one of the genset operating outputs exceeds a respective alarm threshold.

The many features and advantages of the present disclosure are apparent from the written description, and thus, the appended claims are intended to cover all such features and advantages of the disclosure. Further, since numerous modifications and changes will readily occur to those skilled in the art, the present disclosure is not limited to the exact construction and operation as illustrated and described. Therefore, the described embodiments should be taken as illustrative and not restrictive, and the disclosure should not be limited to the details given herein but should be defined by the following claims and their full scope of equivalents, whether foreseeable or unforeseeable now or in the future.

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A generator set monitoring and control system comprising:

a generator set located in a first location;

an on-site controller located near the first location; and a remote display, located in a second location, configured to:

send instructions to at least one of the generator set and on-site controller, receive genset operation outputs from the on-site controller, and display genset operation outputs, wherein the on-site controller has a first user interface associated with an interface layout configuration, and the remote display has a second user interface that is generated based on the interface layout configuration of the first user interface.

2. The system of claim 1, wherein the remote display further includes a user interface configured to display the genset operation outputs.

3. The system of claim 1, wherein the remote display further includes at least one speaker configured to emit an audible alarm signal.

4. The system of claim 1, wherein the interface layout configuration is a human-machine interface configuration file.

5. The system of claim 1, wherein the remote display is configured to translate text of the first user interface into a different language.

6. The system of claim 5, wherein the remote display is configured to display the second user interface with the translated text of the first user interface.

7. The system of claim 1, wherein the genset operation outputs include at least one of a battery monitor, an alternator winding temperature sensor, a lube oil quality monitor, a structural vibration sensor, a bearing failure sensor, an exhaust temperature sensor, and a lube oil pressure sensor.

8. The system of claim 7, wherein the remote display is configured to emit an alarm when at least one of the genset operation outputs exceeds a respective alarm threshold.

9. The system of claim 1, wherein the first location and the second location are different locations, and wherein the first location and the second location are at least 50 km apart.

10. The system of claim 1, further comprising a communication server, wherein communication between the on-site controller and the remote display is routed via the communication server.

11. A remote genset controller comprising:

a display device configured to display a user interface, wherein the user interface is generated based on an interface layout configuration of a second user interface of an on-site controller;

a processor in communication with the display; and a communication module in communication with the processor, the communication module configured to establish communication with the on-site controller, wherein the remote genset controller is configured to:

send instructions to at least one of a generator set and the on-site controller, receive genset operating outputs from the remote genset controller, and display genset operating outputs on the display device.

12. The remote genset controller of claim 11, wherein the remote controller further includes a user interface configured to display the genset operating outputs.

13. The remote genset controller of claim 11, wherein the remote controller further includes at least one speaker configured to emit an audible alarm signal.

14. The remote genset controller of claim 11, wherein the interface layout configuration is a human-machine interface configuration file.

15. The remote genset controller of claim 14, wherein the remote genset controller is configured to translate text of the first user interface into a different language.

16. The remote genset controller of claim 15, wherein the remote genset controller is configured to display the user interface with the translated text of the second user interface.

17. The remote genset controller of claim 11, wherein the genset operating outputs include at least one of a battery monitor, an alternator winding temperature sensor, a lube oil quality monitor, a structural vibration sensor, a bearing failure sensor, an exhaust temperature sensor, and a lube oil pressure sensor.

18. The remote genset controller of claim 17, wherein the remote genset controller is configured to emit an alarm when at least one of the genset operating outputs exceeds a respective alarm threshold.

* * * * *